US012102897B2

(12) United States Patent
Sklar

(10) Patent No.: US 12,102,897 B2
(45) Date of Patent: Oct. 1, 2024

(54) MULTI-PURPOSE GOLF TOOL

(71) Applicant: Andrew W. Sklar, New York, NY (US)

(72) Inventor: Andrew W. Sklar, New York, NY (US)

( * ) Notice: Subject to any disclaimer, the term of this patent is extended or adjusted under 35 U.S.C. 154(b) by 0 days.

(21) Appl. No.: 18/310,237

(22) Filed: May 1, 2023

(65) Prior Publication Data

US 2023/0347219 A1 Nov. 2, 2023

Related U.S. Application Data

(60) Provisional application No. 63/337,345, filed on May 2, 2022.

(51) Int. Cl.
*A63B 57/10* (2015.01)
*A63B 57/30* (2015.01)
*A63B 57/50* (2015.01)

(52) U.S. Cl.
CPC ..... *A63B 57/10* (2015.10); *A63B 57/353* (2015.10); *A63B 57/50* (2015.10)

(58) Field of Classification Search
CPC ..... A63B 57/10; A63B 57/353; A63B 57/50
See application file for complete search history.

(56) References Cited

U.S. PATENT DOCUMENTS

| | | | | | |
|---|---|---|---|---|---|
| D230,409 | S | * | 2/1974 | Schaffer | 473/402 |
| 4,627,621 | A | | 12/1986 | Tate | |
| D316,286 | S | | 4/1991 | Johnson | |
| 5,211,395 | A | | 5/1993 | Liao | |
| D382,929 | S | * | 8/1997 | DeBlieux | D21/717 |
| D385,940 | S | * | 11/1997 | Justice | D27/183 |
| D487,788 | S | | 3/2004 | Impellizeri | |
| D493,859 | S | * | 8/2004 | Lee | D21/793 |
| 7,731,609 | B2 | * | 6/2010 | Wiens | A63B 57/50 473/408 |
| D656,212 | S | | 3/2012 | Cherrie et al. | |
| D775,701 | S | * | 1/2017 | Hinshaw | D21/793 |
| D795,369 | S | * | 8/2017 | Buechler | D21/717 |
| D842,955 | S | | 3/2019 | Johnson | |
| D861,100 | S | | 9/2019 | Jones et al. | |
| D876,560 | S | | 2/2020 | Jones et al. | |

(Continued)

FOREIGN PATENT DOCUMENTS

| | | | | |
|---|---|---|---|---|
| DE | 3537790 | A1 | 4/1987 | |
| GB | 2222090 | A | 2/1990 | |
| WO | WO-9911334 | A1 * | 3/1999 | A63B 57/10 |

*Primary Examiner* — Steven B Wong
(74) *Attorney, Agent, or Firm* — Schmeiser, Olsen & Watts, LLP

(57) ABSTRACT

A multi-purpose golf tool includes a golf tee platform arranged on a golf tool body, the golf tee platform configured to receive a golf ball balanced thereon, a first prong extending from the golf tool body opposite the golf tee platform, a second prong extending from the golf tool body opposite the golf tee platform, a curved depression extending perpendicular to the length and formed by the golf tool body and a portion of the first prong and second prong, and a first rounded gap between the first prong and the second prong. The first prong has a first ridge extending perpendicular to the length and abutting the curved depression. The second prong has a second ridge extending perpendicular to the length and abutting the curved depression.

20 Claims, 9 Drawing Sheets

(56) References Cited

U.S. PATENT DOCUMENTS

| | | | | |
|---|---|---|---|---|
| D918,325 | S | | 5/2021 | Jones et al. |
| D924,348 | S | | 7/2021 | Ubelhor et al. |
| D1,009,194 | S | * | 12/2023 | Lacono ..... D21/717 |
| 2003/0148830 | A1 | | 8/2003 | Hsiao |
| 2006/0100037 | A1 | | 5/2006 | Pels |

* cited by examiner

MULTI-PURPOSE GOLF TOOL

This application claims priority to U.S. Provisional Application Ser. No. 63/337,345, having a filing date of May 2, 2022, the entire contents of which are hereby incorporated by reference.

TECHNICAL FIELD

Golfing equipment, namely, golf tees and golf divot repair tools.

BACKGROUND

Numerous equipment and tools may be used when playing golf, including putters, clubs, wedges, and the like. Further helpful equipment may include golf tees; divot tools, which can be used to repair ball marks in the surface of a putting green; ball markers, which can be used to mark the position of a ball so that the ball can be placed in the exact same location again; and the like. Carrying multiple tools and accessories at once may be cumbersome during game play. A multi-purpose golf tool would be well-received in the art.

SUMMARY

An objective of the embodiments of this disclosure is to provide a golfing accessory that can provide multiple functions and that may provide advantages such as being convenient to use, ergonomic, compact, and easily stored or kept during use.

According to one aspect, a multi-purpose golf tool includes a golf tee platform arranged on a golf tool body, the golf tee platform configured to receive a golf ball balanced thereon; a first prong extending from the golf tool body opposite the golf tee platform; a second prong extending from the golf tool body opposite the golf tee platform, wherein the multi-purpose golf tool extends a length between the golf tee platform and ends of the first and second prongs; a curved depression extending perpendicular to the length and formed by the golf tool body and a portion of the first prong and second prong; and a first rounded gap between the first prong and the second prong, wherein the first prong has a first ridge extending perpendicular to the length and abutting the curved depression, and wherein the second prong has a second ridge extending perpendicular to the length and abutting the curved depression.

DESCRIPTION

A detailed description of the hereinafter-described embodiments of the disclosed apparatus and method are presented herein by way of exemplification and not limitation with reference made to the Figures. Although certain embodiments are shown and described in detail, it should be understood that various changes and modifications might be made without departing from the scope of the appended claims. The scope of the present disclosure will in no way be limited to the number of constituting components, the materials thereof, the shapes thereof, colors thereof, the relative arrangement thereof, etc., and are disclosed simply as an example of embodiments of the present disclosure. A more complete understanding of the present embodiments and advantages thereof may be acquired by referring to the following description taken in conjunction with the accompanying drawings, in which like reference numbers indicate like features.

Figure 1:
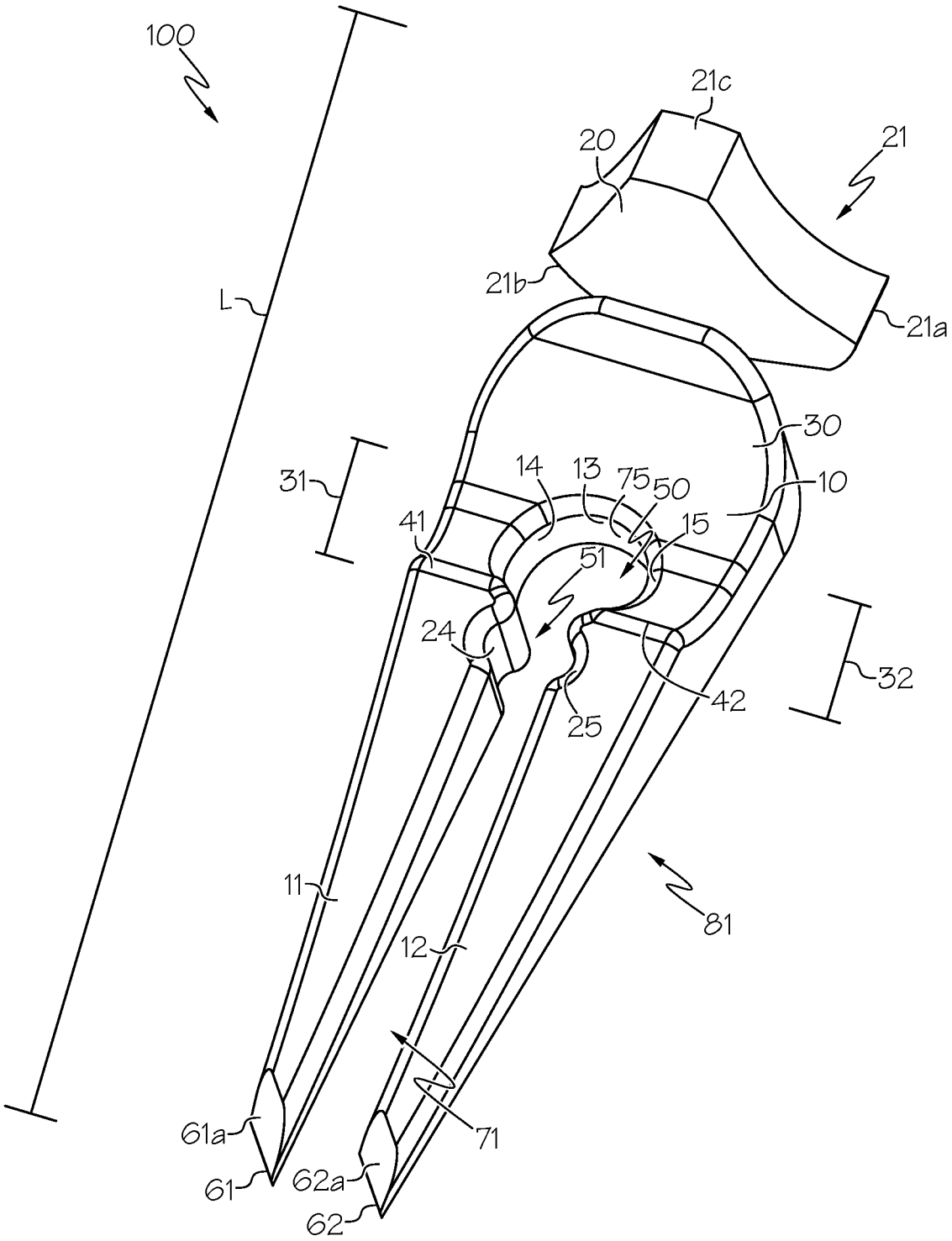
FIG. 1 depicts a perspective view of a multi-purpose golf tool according to an embodiment.

FIG. 1 is a perspective view of an embodiment of a multi-purpose golf tool 100. The multi-purpose golf tool 100 has a golf tool body 10. The multi-purpose golf tool 100 includes a golf tee platform 20 arranged on the golf tool body 10. The golf tee platform 20 is configured to receive a golf ball balanced thereon when the multi-purpose golf tool 100 is inserted upright into the ground. In this embodiment, the golf tee platform 20 has a three-pronged structure for receiving a golf ball, with each golf tee platform prong 21*a*, 21*b*, 21*c* curving upwards to stabilize a golf ball. In other embodiments, the golf tee platform 20 may have a different shape, such as a circular shape, a rectangle shape, and the like.

The multi-purpose golf tool 100 has a first prong 11 and a second prong 12 that extend from the golf tool body 10. In this embodiment, the first prong 11 and the second prong 12 are tapered such that a first prong end 61 of the first prong 11 and a second prong end 62 of the second prong 12 are narrower than the first prong 11 and second prong 12 closer to the golf tool body 10. The multi-purpose golf tool 100 extends a length L between the golf tee platform 20 and ends of the first and second prongs 61, 62. In this embodiment, the first prong 11 and second prong 12 have a rectangular cross section with curved corners. The first prong 11 and second prong 12 are not limited to having a rectangular cross section with curved corners. For example, the first prong 11 and second prong 12 may have any shaped cross section, such as a cross section that is circular, triangular, hexagonal, and the like. In this embodiment, the first prong end 61 has a flat slanted face 61*a*, and the second prong end 62 has a flat slanted face 62*a*. The flat slanted faces 61*a*, 62*a* may facilitate the insertion of the multi-purpose golf tool 100 into the ground, and facilitate use of the multi-purpose golf tool 100 as a divot tool. Specifically, the first and second prong ends 61, 62 may be pointed such that the ends are configured to act as a divot repair tool.

The multi-purpose golf tool 100 may be made out of plastic, wood, metal, a composite material, or the like. The multi-purpose golf tool 100 may be made out of more than one material. For example, the golf tee platform 20 may be made out of a first material and the golf tool body 10 and the first prong 11 and second prong 12 may be made out of a second, different material. The multi-purpose golf tool 100 may be made as a continuous single piece of material, such as made from a mold. The multi-purpose golf tool 100 may be 3-D printed. The multi-purpose golf tool 100 may be made from multiple connected parts. For example, the golf tee platform 20 may be removably attachable to the golf tool body 10 such as by screwing into the golf tool body 10, or by a peg and hole configuration, or the like. As another example, the first prong 11 and second prong 12 may be removably attachable to the golf tool body 10, such as by screwing into the golf tool body 10, or by a peg and hole configuration, or the like.

As further shown in the embodiment depicted in FIG. 1, the multi-purpose golf tool 100 includes a curved depression 30 along its length L. In this embodiment, the curved depression 30 may be a channel which extends perpendicular to the length L of the multi-purpose golf tool 100. Thus, the curved depression 30 may be considered a channel extending along an axis which is perpendicular to the length L of the multi-purpose golf tool 100. The curved depression 30 in some embodiments may include a consistent or constant cross-sectional profile which extends perpendicular to the length L. The golf tool body 10 forms part of the curved depression 30. A portion 31 of a length of the first prong and a portion 32 of a length of the second prong 12 form the curved depression 30 as well. The depression 30 may be shaped and dimensioned to ergonomically receive a finger of a user so that the user can grip the multi-purpose golf tool 100 for insertion into the ground, securely clip the multi-purpose golf tool 100 to a hat brim, grip the multi-purpose golf tool 100 for use as a divot tool, and the like.

The first prong 11 includes a ridge 41 at which the curved depression 30 terminates, and the second prong includes a ridge 42 at which the curved depression 30 terminates. The ridges 41 and 42 could be located at another location along the first prong 11 and second prong 12. The ridges 41, 42 may further be bumps, notches, ribs, and the like. The ridges 41, 42 may provide further stability to a user's grip of the multi-purpose golf tool 100, particularly to index the golf tee platform 20 and provide leverage when the multi-purpose golf tool 100 is inserted into the ground. The multi-purpose golf tool 100 is not limited to having a single curved depression 30 along its length. The multi-purpose golf tool 100 may have one or more curved depressions 30 along its length to receive multiple fingers of a user. One or more curved depressions 30 of the multi-purpose golf tool 100 may be differently sized.

With continuing reference to FIG. 1, in this embodiment, a circular gap 50 is arranged between the first prong 11 and the second prong 12 proximate to where the first prong 11 and second prong 12 abut the golf tool body 10. The circular gap 50 is not limited to being arranged proximate to where the first prong 11 and second prong 12 abut the tool body 10, for example, the circular gap 50 may be arranged at a location along a length of the first prong 11 and second prong 12. The circular gap 50 is not limited to being circular and could have another shape such as an oval, a rectangle, a triangle, and the like. The circular gap 50 may be an opening, a through-hole, a bore, and the like. In the embodiment shown in FIG. 1, the circular gap 50 is formed by a concave inner surface 13 of the golf tool body 10 that is contiguous with a concave inner surface 14 of the first prong 11 and is contiguous with a concave inner surface 15 of the second prong 12. In the embodiment shown in FIG. 1, the multi-purpose golf tool 100 has a second circular gap 51 arranged between the first prong 11 and second prong 12 that is formed by a concave shaped curve 24 in the inner surface of the first prong 11 arranged across from a concave shaped curve 25 in the inner surface of the second prong 12. The first circular gap 50 and second circular gap 51 may each have a different diameter, for example, in the embodiment shown in FIG. 1, the first circular gap 50 may have a larger diameter than the diameter of the second circular gap 51.

With yet continuing reference to FIG. 1, the first circular gap 50 and the second circular gap 51 may be configured to receive and clamp down on the brim of a hat or cap and secure the multi-purpose golf tool 100 to the brim of a hat or cap while the multi-purpose golf tool 100 is not in use. The golf tool 100 can thereby easily be stored, transported, and accessed by a user. The first circular gap 50 may have a textured surface to facilitate secure attachment of the multi-purpose golf tool 100 to a hat or cap brim. As another example, the first circular gap 50 may include a rubber layer, a fabric layer, or the like.

An opening 71 is thereby formed between the first and second prongs 11, 12, and includes the first and second circular gaps 50, 51. The opening 71 may be considered a gap, space, slot or the like. A width of the opening 71 may be particularly dimensioned in order to receive the brim of a hat or cap, as described above. In particular, the first and second prongs 11, 12 may be made of an elastically deformable material which slightly bends in order to receive the brim of a hat or cap, and then maintain a clamping force on the brim. Thus, a hat brim may have a slightly larger thickness than the opening 71 so that the first and second prongs 11, 12 clamp thereon when the brim of the hat is inserted within the opening 71. The first and second circular gaps 50, 51 may each define width narrowing protrusions 72, 74 of the opening 71. These protrusions 72, 74 may further be dimensioned so that the opening 71 therebetween is slightly narrower than the thickness of a brim of an athletic or baseball cap.

The opening 71 extends lengthwise along the length L of the multi-purpose golf tool 100 from the prong ends 61*a*, 62*a* to an opening end 75 located in the curved depression 30 proximate the golf tee platform 20. The first and second circular gaps 50, 51 may be located proximate the golf tee platform 20 and distal to the prong ends 61*a*, 62*a*. In particular, the second circular gap 51 is spaced apart along the length L and located closer to prong ends 61*a*, 62*a* of the first and second prongs 61, 62 than the first rounded gap 52. It should be understood that the first and second circular gaps 50, 51 may not be perfectly circular in shape, but may be rounded, ovular, annular, ring-shaped, or any other curved or rounded shape.

Figure 2:
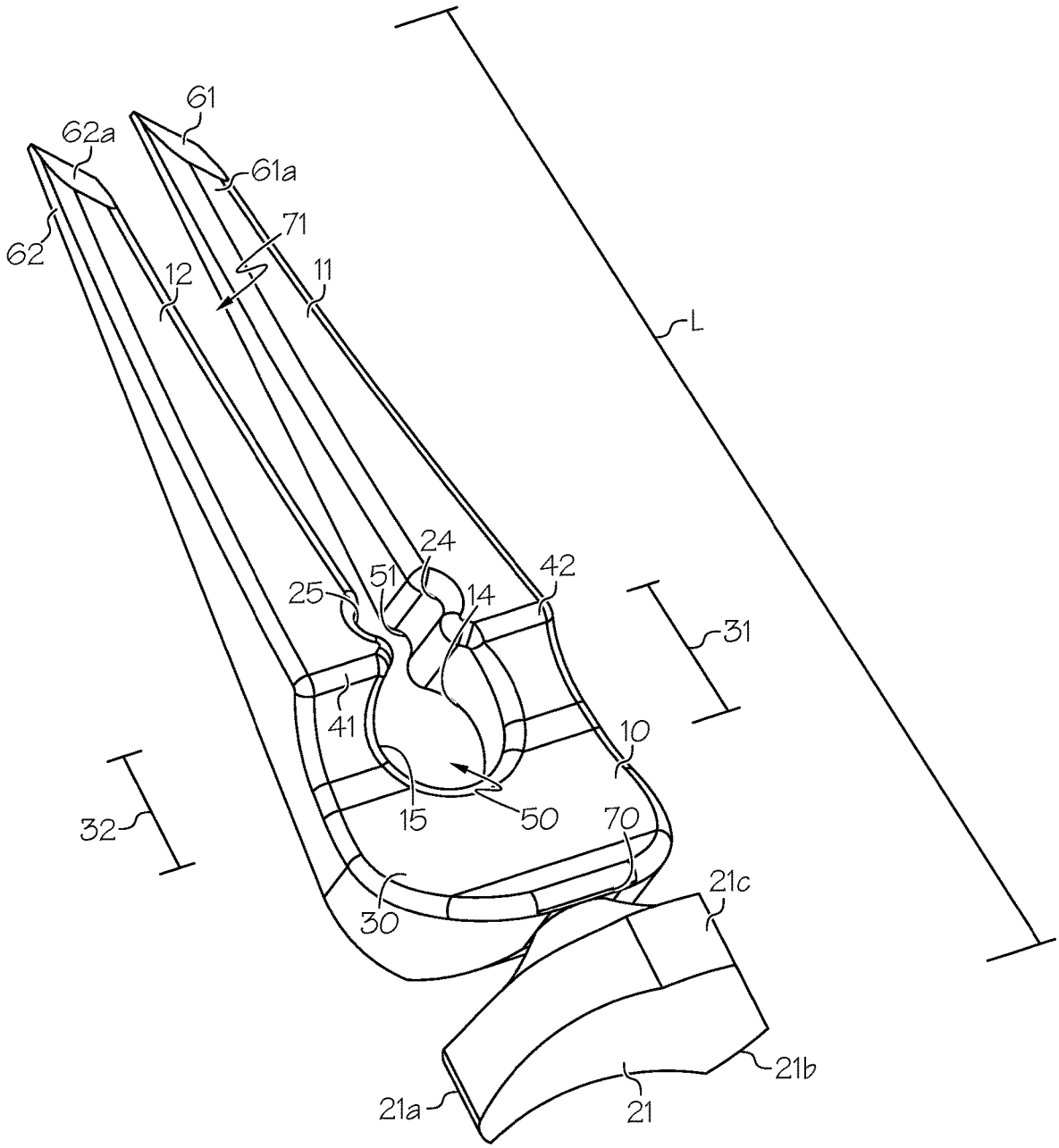
FIG. 2 depicts another perspective view of the multi-purpose golf tool of FIG. 1 according to an embodiment.

Referring now to FIG. 2, another perspective view of the multi-purpose golf tool 100 is shown according to an embodiment. In this embodiment, the golf tee platform 20 has a curved concave surface 21. In an embodiment in which the golf tee platform 20 is removably attached to the golf tool body 10, the golf tee platform 20 may attach to the golf tool body 10 on a top 70 of the golf tool body 10.

Figure 3:
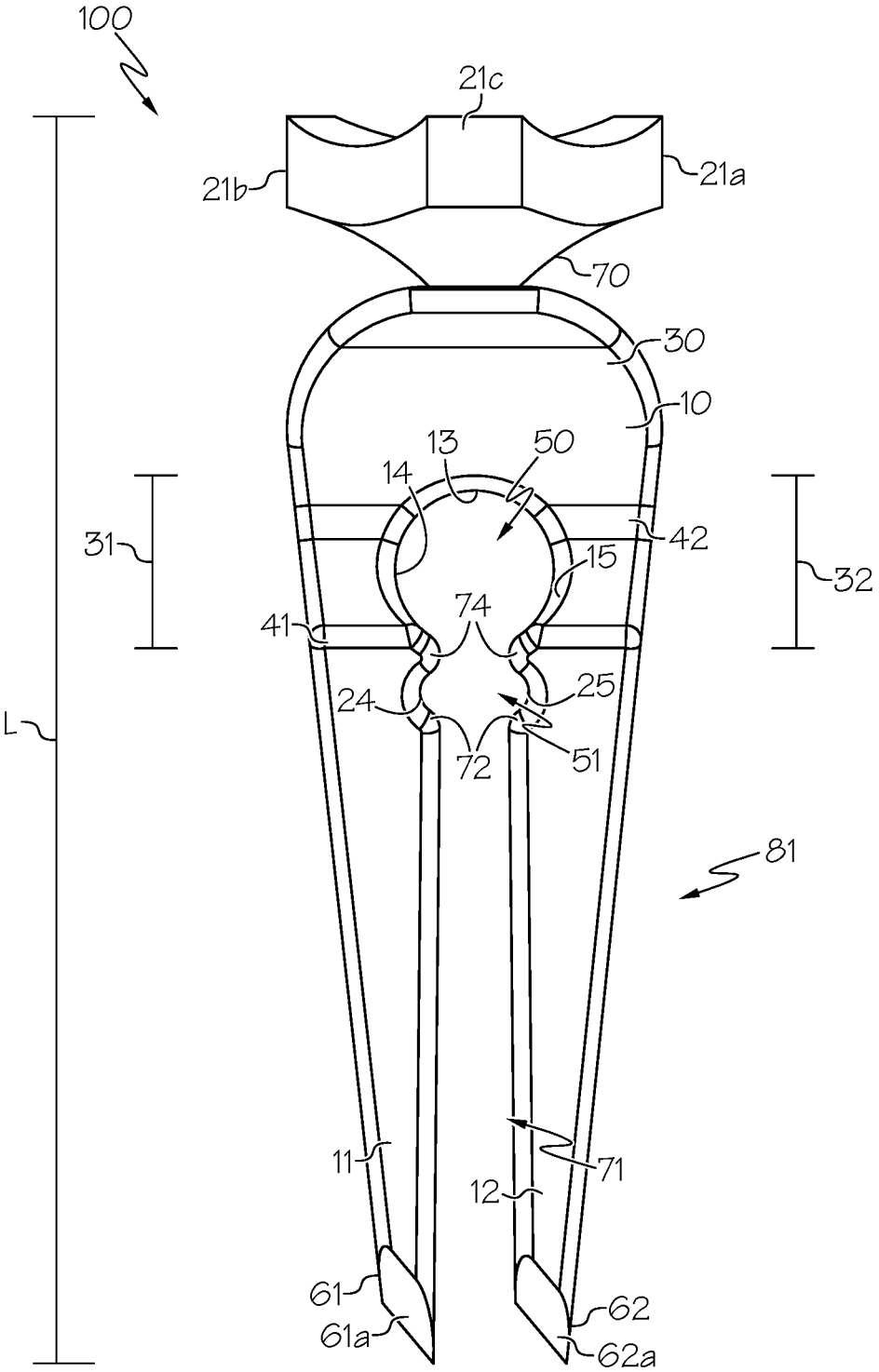
FIG. 3 depicts a front view of the multi-purpose golf tool of FIG. 1 according to an embodiment.

Referring now to FIG. 3, a front view of the multi-purpose golf tool 100 is shown according to an embodiment. In this embodiment, the multi-purpose golf tool 100 is vertically symmetrical. In other embodiments, the multi-purpose golf tool 100 may not be symmetrical. For example, the first prong 11 and the second prong 12 may be differently shaped or have different lengths, or the like. As another example, the first circular gap 50 and second circular gap 51 may not be symmetrically shaped.

Figure 4:
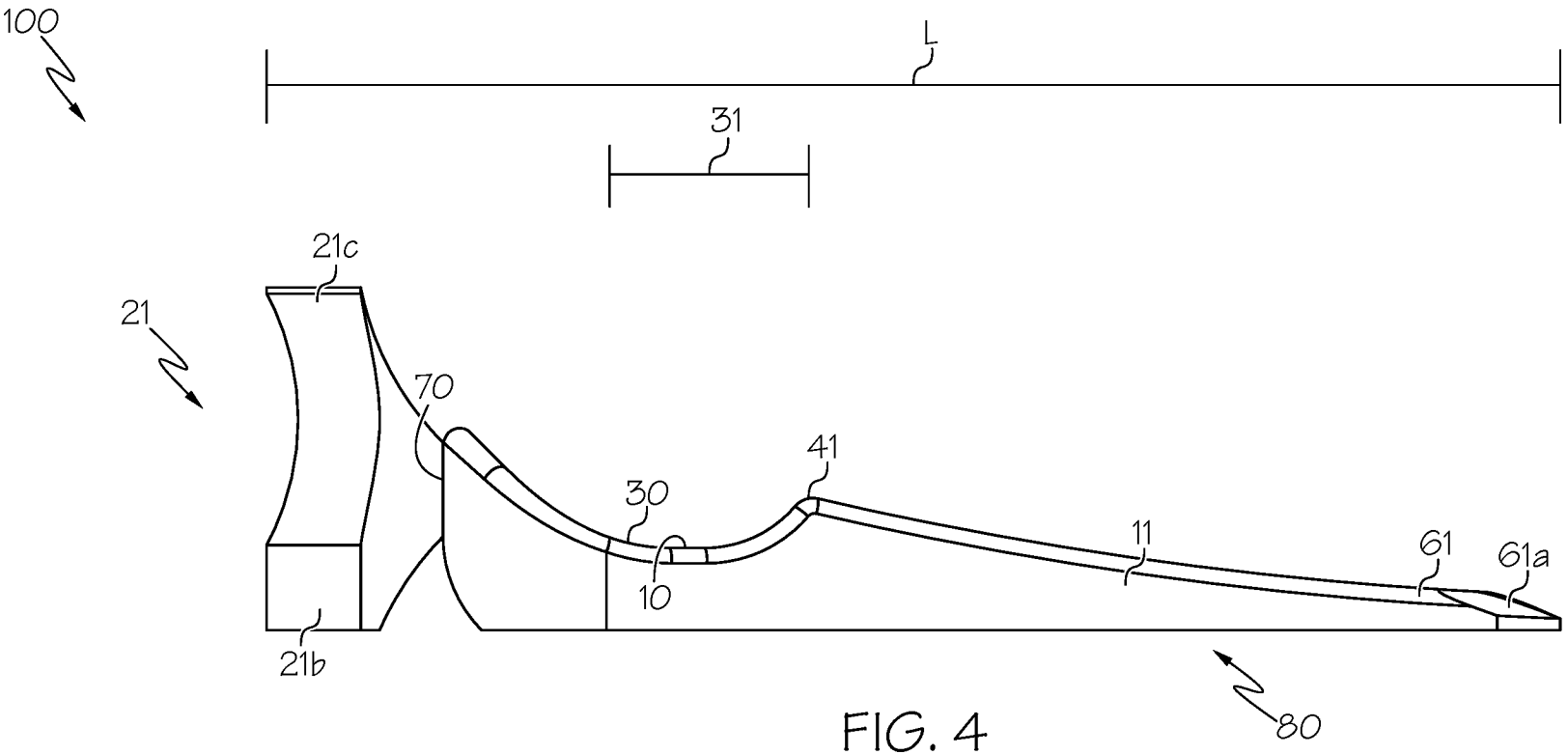
FIG. 4 depicts a side view of the multi-purpose golf tool of FIG. 1 according to an embodiment.

Referring now to FIG. 4, a side view of the multi-purpose golf tool 100 is shown according to an embodiment. In this embodiment, the back side 80 of the multi-purpose golf tool 100 is flat. In other embodiments, both the front 81 and the back 80 of the multi-purpose golf tool 100 may have one or more of a curved depression and a ridge on the first prong 11 and a ridge on the second prong 12. In an embodiment, the back 80 side of the multi-purpose golf tool 100 may include a ball marker that is removably attachable to the multi-purpose golf 100, such as by a snap-fit, by magnets, by a sleeve on the back side 80 of the multi-purpose golf tool 100 in which the ball marker can be inserted, and the like.

Figure 5:
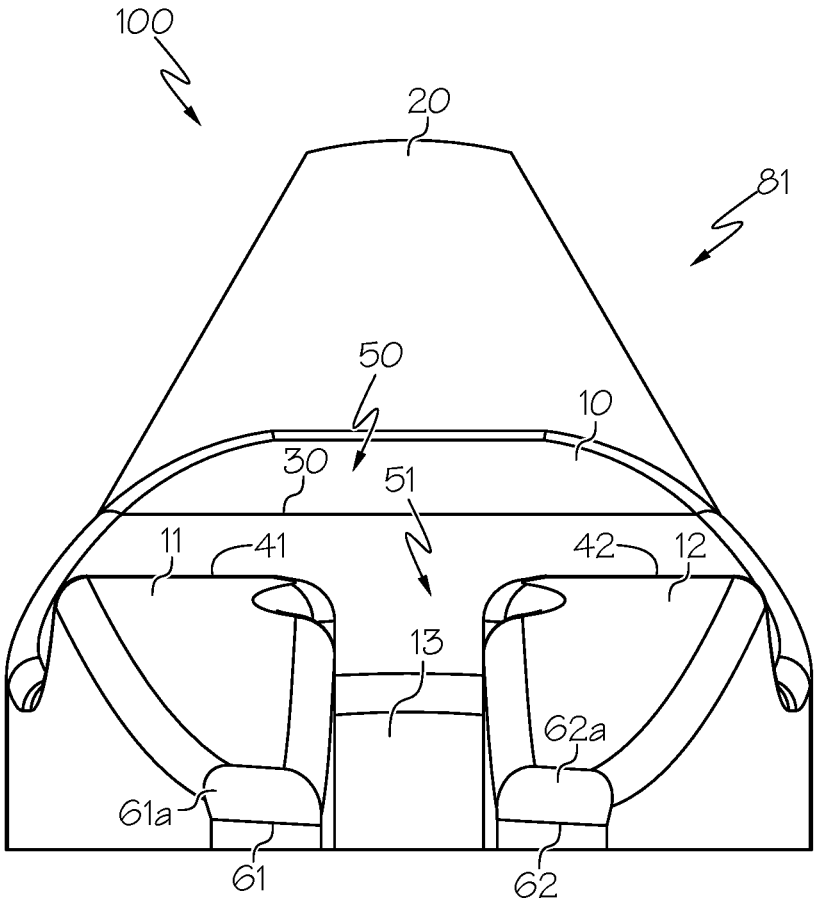
FIG. 5 depicts a bottom view of the multi-purpose golf tool of FIG. 1 according to an embodiment.

Referring now to FIG. 5, a bottom view of the multi-purpose golf tool 100 is shown according to an embodiment. As shown, the flat slanted face 61*a* and flat slanted face 62*a* of the first prong 11 and second prong 12 each provide an edge 61*b*, 62*b* that can be used to insert the multi-purpose golf tool 100 into the ground, as well as facilitate the divot tool function of the multi-purpose golf tool 100.

Figure 6:
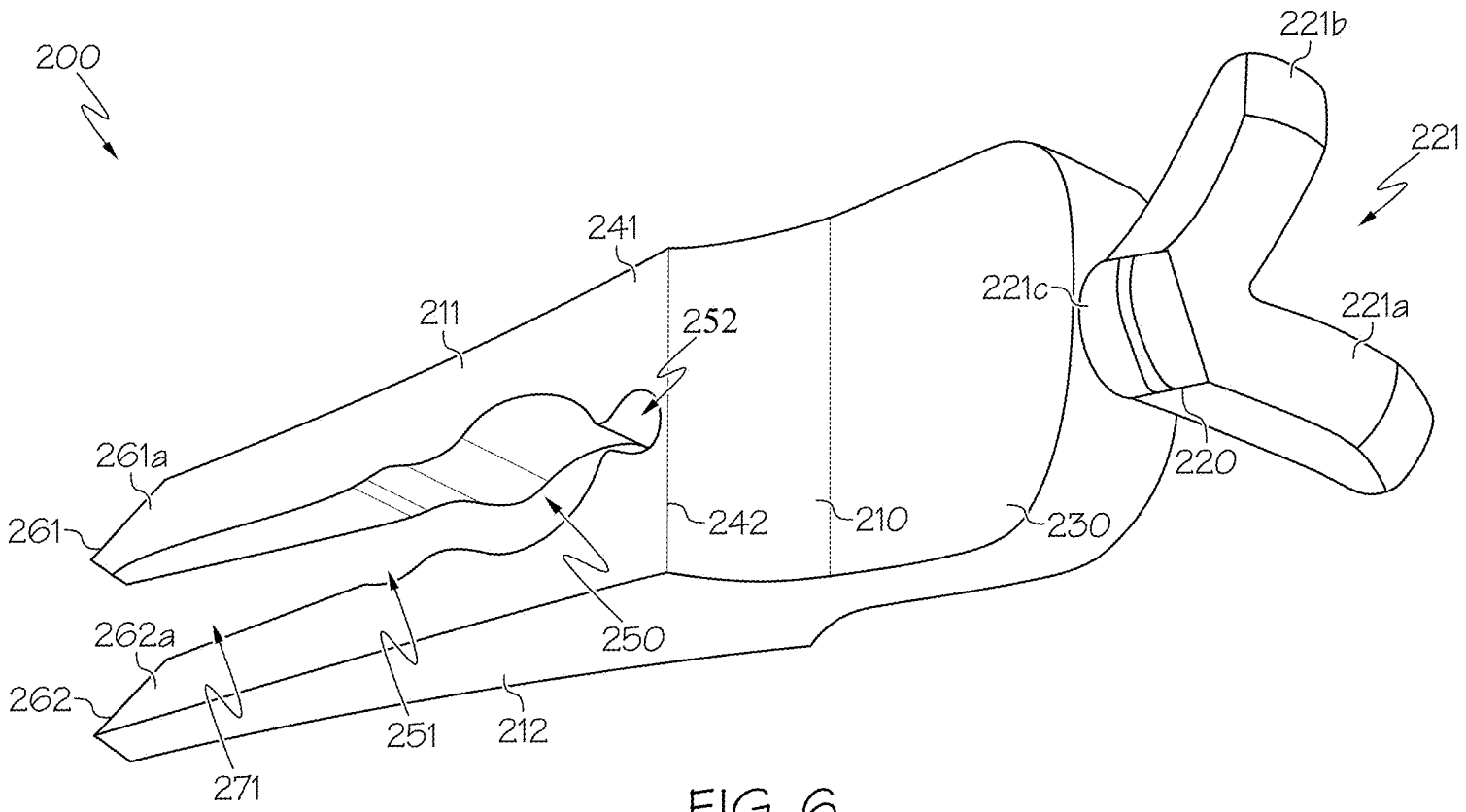
FIG. 6 depicts a perspective view of a multi-purpose golf tool according to an embodiment.
Figure 7:
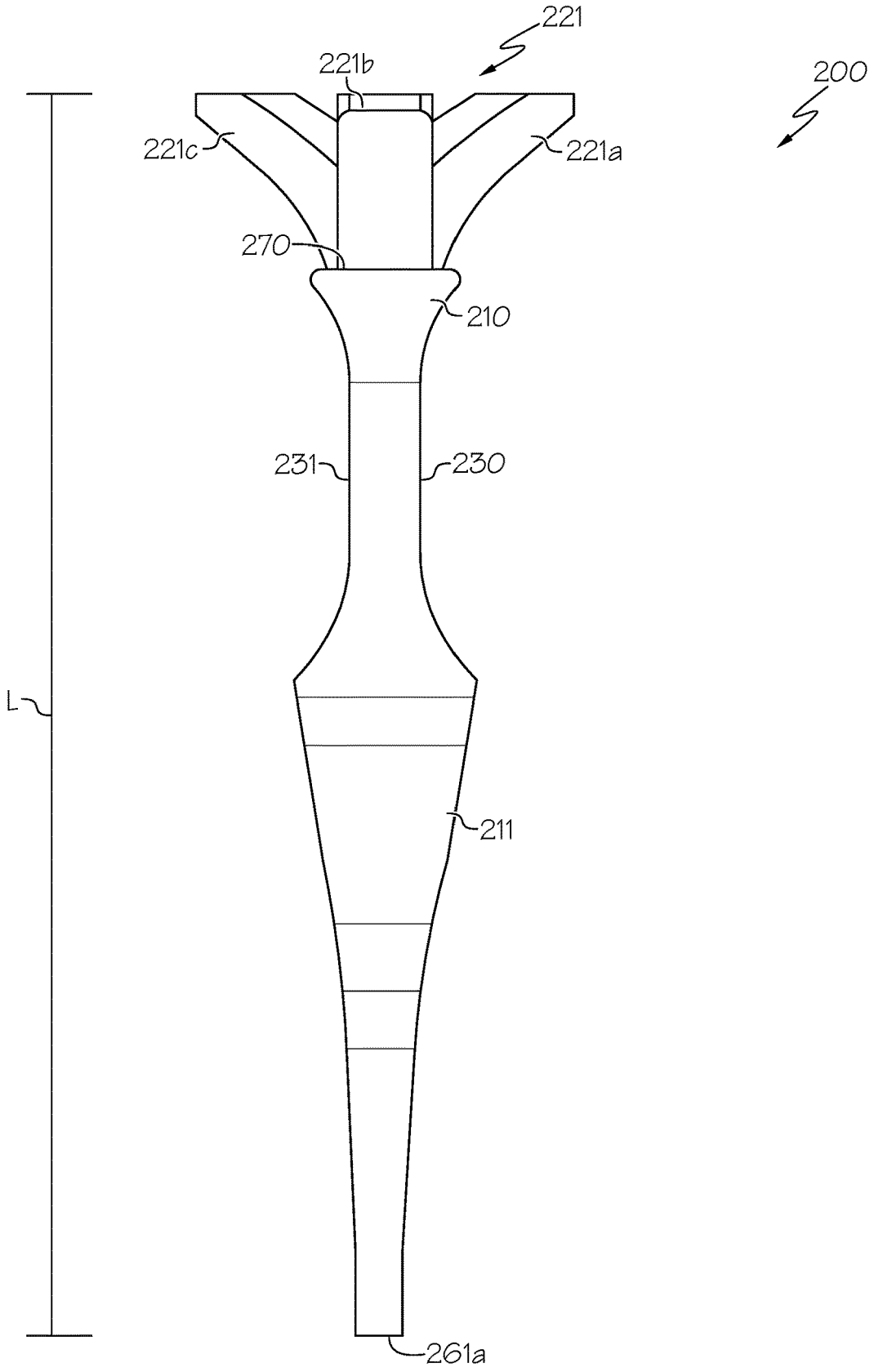
FIG. 7 depicts a side view of the multi-purpose golf tool of FIG. 6, according to an embodiment.
Figure 8:
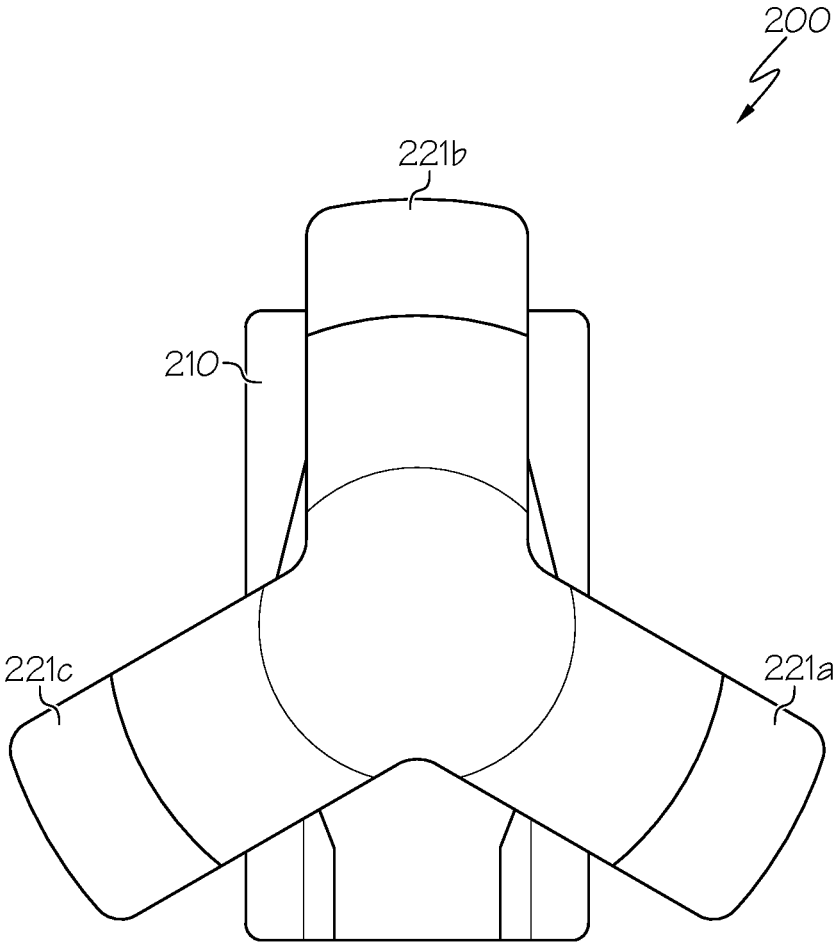
FIG. 8 depicts a top view of the multi-purpose golf tool of FIG. 6, according to an embodiment.
Figure 9:
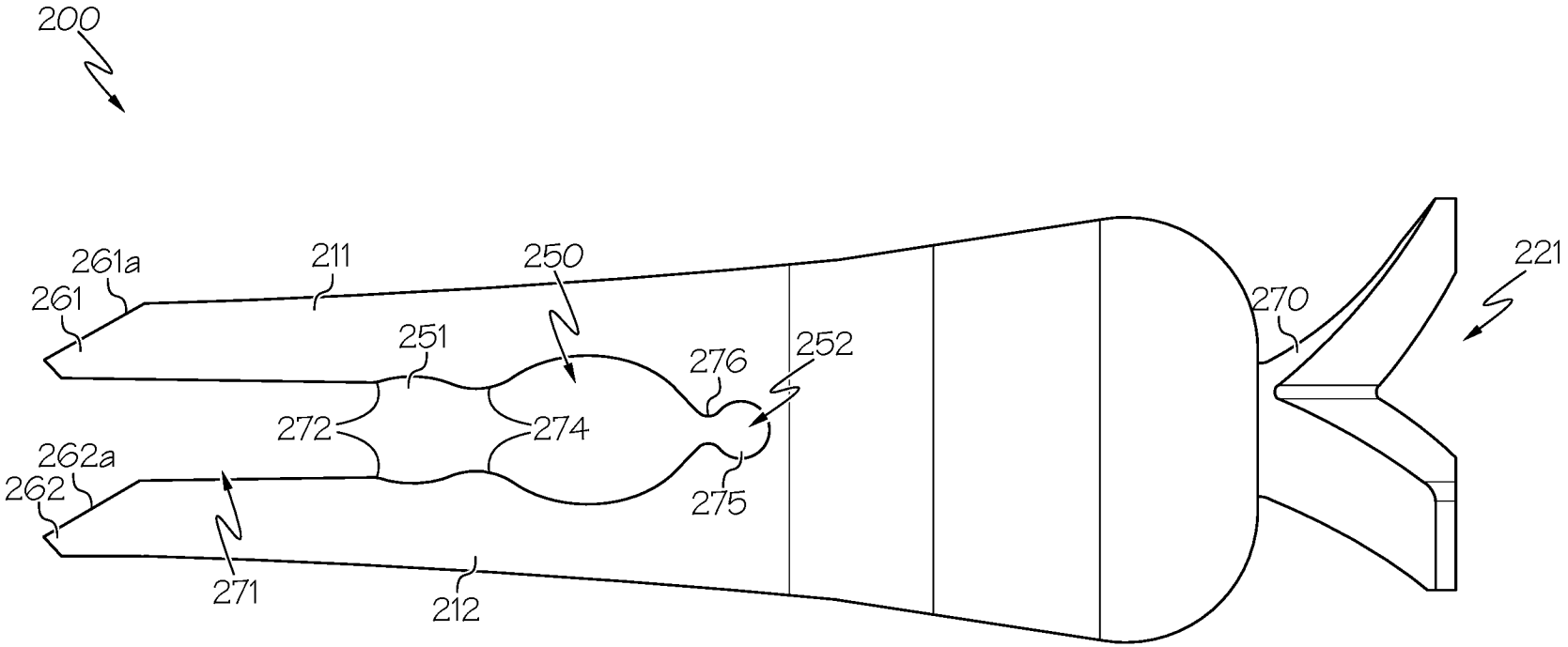
FIG. 9 depicts a front view of the multi-purpose golf tool of FIG. 6 according to an embodiment.

FIGS. 6-9 depict various views of another multi-purpose golf tool 200, according to a second exemplary embodiment. In particular, FIG. 6 depicts a perspective view of the multi-purpose golf tool 200, FIG. 7 depicts a side view of the multi-purpose golf tool 200, FIG. 8 depicts a top view of the multi-purpose golf tool 200, and FIG. 9 depicts a front view of the multi-purpose golf tool 200. The multi-purpose golf tool 200 may be similar, and include the various features of, the multi-purpose golf tool 100 described herein above. However, the multi-purpose golf tool 200 includes variations and/or alternative features relative to the multi-purpose golf tool 100 which will be detailed herein after.

Like the multi-purpose golf tool 100, the multi-purpose golf tool 200 includes a golf tool body 210. The multi-purpose golf tool 200 includes a golf tee platform 220 arranged on the golf tool body 210. The golf tee platform 220 is configured to receive a golf ball balanced thereon when the multi-purpose golf tool 200 is inserted upright into the ground. In this embodiment, the golf tee platform 220 has a three-pronged structure for receiving a golf ball, with each golf tee platform prong 221*a*, 221*b*, 221*c* curving upwards to stabilize a golf ball. Unlike the golf tee platform 20 of the multi-purpose golf tool 100, the prongs 221*a*, 221*b*, 221*c* are three distinct elongated fingers.

Similar to the multi-purpose golf tool 100, the multi-purpose golf tool 200 has a first prong 211 and a second prong 212 that extend from the golf tool body 210. The first prong 211 and the second prong 212 are tapered such that a first prong end 261 of the first prong 211 and a second prong end 262 of the second prong 212 are narrower than the first prong 211 and second prong 212 closer to the middle of the golf tool body 210. The multi-purpose golf tool 200 extends a length L between the golf tee platform 220 and ends of the first and second prongs 261, 262. The first prong end 261 has a flat slanted face 261*a*, and the second prong end 262 has a flat slanted face 262*a*. The flat slanted faces 261*a*, 262*a* may facilitate the insertion of the multi-purpose golf tool 200 into the ground, and facilitate use of the multi-purpose golf tool 200 as a divot tool. Specifically, the first and second prong ends 261, 262 may be pointed such that the ends are configured to act as a divot repair tool.

As further shown, the multi-purpose golf tool 200 includes a curved depression 230 along its length L, like the curved depression 30 of the multi-purpose golf tool 100. Unlike the multi-purpose golf tool 100, the multi-purpose golf tool 200 includes a pair of curved depressions 30, one on each face of the multi-purpose golf tool 200. The first prong 211 includes a ridge 241 at which the curved depression 230 terminates, and the second prong includes a ridge 242 at which the curved depression 230 terminates. While not shown in FIG. 6, the curved depression 230 on the opposing face of the multi-purpose golf tool 200 includes the same structure. While the ridges 241, 242 are shown closer to the golf tee platform 220 than the opening 271, the ridges 241 and 242 could be located at another location along the first prong 211 and second prong 212. The ridges 241, 242 may further be bumps, notches, ribs, and the like. The ridges 241, 242 may provide further stability to a user's grip of the multi-purpose golf tool 200, particularly to index the golf tee platform 220 and provide leverage when the multi-purpose golf tool 200 is inserted into the ground for repairing a divot and/or teeing a golf ball.

In this embodiment, a first rounded gap 250 is arranged between the first prong 211 and the second prong 212 proximate to where the first prong 211 and second prong 212 abut the golf tool body 210. The first rounded gap 250 is not limited to being arranged proximate to where the first prong 211 and second prong 212 abut the tool body 210, for example, the first rounded gap 250 may be arranged at a location along a length of the first prong 211 and second prong 212. The rounded gap 250 may be ovular as shown, or may be circular or have another rounded shape, or non-rounded shape such as an, a rectangle, a triangle, and the like. The first rounded gap 250 may be an opening, a through-hole, a bore, and the like. The first rounded gap 250 is formed by a concave inner surface of the golf tool body 210 that is contiguous with a concave inner surface of the first prong 211 and is contiguous with a concave inner surface of the second prong 212.

In the embodiment shown, the multi-purpose golf tool 200 has a second rounded gap 251 arranged between the first prong 211 and second prong 212 that is formed by a concave shaped curve in the inner surface of the first prong 211 arranged across from a concave shaped curve in the inner surface of the second prong 212. The first rounded gap 250 and second rounded gap 251 may each have a different diameter, for example, in the embodiment shown in FIG. 1, the first rounded gap 250 may be a primary gap having a larger diameter than the diameter of the second rounded gap 251.

With yet continuing reference to FIG. 1, the first rounded gap 250 and the second rounded gap 251 may be configured to receive and clamp down on the brim of a hat or cap and secure the multi-purpose golf tool 200 to the brim of a hat or cap while the multi-purpose golf tool 200 is not in use. The golf tool 200 can thereby easily be stored, transported, and accessed by a user. The first rounded gap 250 may have a textured surface to facilitate secure attachment of the multi-purpose golf tool 200 to a hat or cap brim. As another example, the first rounded gap 250 may include a rubber layer, a fabric layer, or the like.

In the embodiment shown, the multi-purpose golf tool 200 has a third rounded gap 252 arranged between the first prong 211 and second prong 212 that is formed by a concave shaped curve in the inner surface of the first prong 211 arranged across from a concave shaped curve in the inner surface of the second prong 212. The third rounded gap 252 may be a smaller gap having a smaller diameter and define a smaller opening width than the first rounded gap 250 and the second rounded gap 251.

An opening 271 is thereby formed between the first and second prongs 211, 212, and includes the first, second and third rounded gaps 250, 251, 252. The opening 271 may be considered a gap, space, slot or the like. A width of the opening 271 may be particularly dimensioned in order to receive the brim of a hat or cap, as described above. In particular, the first and second prongs 211, 212 may be made of an elastically deformable material which slightly bends in order to receive the brim of a hat or cap, and then maintain a clamping force on the brim. Thus, a hat brim may have a slightly larger thickness than the opening 271 so that the first and second prongs 211, 212 clamp thereon when the brim of the hat is inserted within the opening 271. The first and second rounded gaps 250, 251 may each define width narrowing protrusions 272, 274 of the opening 271. These protrusions 272, 274 may further be dimensioned so that the opening 271 therebetween is slightly narrower than the thickness of a brim of an athletic or baseball cap at the point at the protrusions 272, 274.

The opening 271 extends lengthwise along the length L of the multi-purpose golf tool 200 from the prong ends 261*a*, 262*a* to an opening end 275 located between the curved depressions 230, 231 proximate the golf tee platform 220. The first, second and third rounded gaps 250, 251, 252 may be located proximate the golf tee platform 220 and distal to the prong ends 261*a*, 262*a*. In particular, the second rounded gap 251 is spaced apart along the length L and located closer to prong ends 261*a*, 262*a* of the first and second prongs 261, 262 than the first rounded gap 252. The third rounded gap 252 may be located closer to the golf tee platform 220 than the first primary rounded gap 250.

The third rounded gap 252 may thereby include a gap width that is narrower than the gap width of each of the first and second rounded gaps 250, 251. This narrower gap width may be much narrower than a width of a baseball hat brim, and may be narrow enough to receive and maintain a clamping force on a fabric material of a golf shirt.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The conjunction "or" when used with a list of at least two terms is intended to mean any term or combination of terms. The terms "first" and "second" are used to distinguish elements and are not used to denote a particular order.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A multi-purpose golf tool comprising:

a golf tee platform arranged on a golf tool body, the golf tee platform configured to receive a golf ball balanced thereon;

a first prong extending from the golf tool body opposite the golf tee platform;

a second prong extending from the golf tool body opposite the golf tee platform, wherein the multi-purpose golf tool extends a length between the golf tee platform and ends of the first and second prongs;

a curved depression extending perpendicular to the length and formed by the golf tool body and a portion of the first prong and second prong; and a first rounded gap between the first prong and the second prong, wherein the first prong has a first ridge extending perpendicular to the length and abutting the curved depression, and wherein the second prong has a second ridge extending perpendicular to the length and abutting the curved depression.

2. The multi-purpose golf tool of claim 1, further comprising a second rounded gap between the first prong and the second prong.

3. The multi-purpose golf tool of claim 2, further comprising an opening formed between the first and second prongs, wherein the opening includes the first and second rounded gaps.

4. The multi-purpose golf tool of claim 3, wherein the opening includes a width that is dimensioned to receive a brim of a baseball cap.

5. The multi-purpose golf tool of claim 4, wherein the first and second prongs are made of an elastically deformable material that is configured to bend to receive the brim of the baseball cap and maintain a clamping force on the received brim of the baseball cap.

6. The multi-purpose golf tool of claim 5, wherein the first and second rounded gaps defined width-narrowing protrusions of the opening, wherein the width narrowing protrusions of the opening define a gap width of each of the first and second rounded gaps.

7. The multi-purpose golf tool of claim 2, wherein the second rounded gap is spaced apart along the length and located closer to prong ends of the first and second prongs than the first rounded gap.

8. The multi-purpose golf tool of claim 7, further comprising a third rounded gap spaced apart along the length and located closer to the golf tee platform than the first and second rounded gaps.

9. The multi-purpose golf tool of claim 8, wherein the third rounded gap includes a gap width that is narrower than the gap width of each of the first and second rounded gaps.

10. The multi-purpose golf tool of claim 9, wherein the gap width of the third rounded gap is configured to receive and maintain a clamping force on a fabric material of a golf shirt.

11. The multi-purpose golf tool of 2, wherein the first and second rounded gaps form a circular or ovular shape.

12. The multi-purpose golf tool of claim 11, further comprising a second curved depression extending perpendicular to the length.

13. The multi-purpose golf tool of claim 12, wherein the second curved depression is smaller or larger than the first curved depression.

14. The multi-purpose golf tool of claim 1, wherein the first prong and the second prong are tapered and extend to a pointed end such that the first and second prong are configured as a divot repair tool.

15. The multi-purpose golf tool of claim 1, wherein the curved depression and the first ridge and the second ridge are arranged on a front side of the multi-purpose golf tool, and a back side of the multi-purpose golf tool is flat.

16. The multi-purpose golf tool of claim 1, wherein the golf tee platform is removably attached to the golf tee body.

17. The multi-purpose golf tool of claim 1, wherein the curved depression and the first ridge and the second ridge are arranged on a front side of the multi-purpose golf tool, and wherein a second curved depression and a third ridge and a fourth ridge are arranged on a back side of the multi-purpose golf tool.

18. The multi-purpose golf tool of claim 1, wherein the first prong and the second prong each have a rectangular cross section.

19. The multi-purpose golf tool of claim 1, wherein the rounded gap includes a textured surface.

20. The multi-purpose golf tool of claim 1, wherein the golf tee platform is defined by a plurality of platform prongs.

* * * * *